US008725051B2

(12) United States Patent
Yoshida et al.

(10) Patent No.: US 8,725,051 B2
(45) Date of Patent: May 13, 2014

(54) HEAT-PRODUCING FIXING BELT AND IMAGE FORMING APPARATUS USING THE SAME

(75) Inventors: Eiichi Yoshida, Tokyo (JP); Susumu Sudo, Tokyo (JP); Yasuo Kurachi, Tokyo (JP); Kotaro Takebe, Tokyo (JP); Izumi Mukoyama, Tokyo (JP)

(73) Assignee: Konica Minolta Business Technologies, Inc., Tokyo (JP)

( * ) Notice: Subject to any disclaimer, the term of this patent is extended or adjusted under 35 U.S.C. 154(b) by 125 days.

(21) Appl. No.: 13/569,827

(22) Filed: Aug. 8, 2012

(65) Prior Publication Data

US 2013/0045034 A1 Feb. 21, 2013

(30) Foreign Application Priority Data

Aug. 18, 2011 (JP) ..... 2011-178780

(51) Int. Cl.
*G03G 15/20* (2006.01)

(52) U.S. Cl.
CPC ..... *G03G 15/2057* (2013.01)
USPC ..... 399/333; 399/130; 399/330

(58) Field of Classification Search
USPC ..... 399/130, 330, 333
See application file for complete search history.

(56) References Cited

U.S. PATENT DOCUMENTS

| | | | | |
|---|---|---|---|---|
| 7,321,746 | B2 * | 1/2008 | Sakakibara et al. | 399/333 |
| 2011/0013955 | A1 * | 1/2011 | Choi et al. | 399/333 |

FOREIGN PATENT DOCUMENTS

| | | |
|---|---|---|
| JP | 2006-343538 | 12/2006 |
| JP | 2007-272223 | 10/2007 |
| JP | 2009-109997 | 5/2009 |

* cited by examiner

*Primary Examiner* — Walter L Lindsay, Jr.
*Assistant Examiner* — Roy Y Yi
(74) *Attorney, Agent, or Firm* — Lucas & Mercanti, LLP

(57) ABSTRACT

Disclosed is a heat-producing fixing belt of a cylindrical shape which is composed of a heat-producing layer, an elastic layer, and a releasing layer in this sequential order from the inner side, and the heat-producing layer contains a polyimide resin and fabric containing carbon fiber and a pair of electrodes to supply power to the heat-producing layer making contact with the fabric containing carbon fiber are provided on both ends of the cylindrical shape.

6 Claims, 5 Drawing Sheets

HEAT-PRODUCING FIXING BELT AND IMAGE FORMING APPARATUS USING THE SAME

This application is based on Japanese Patent Application No. 2011-178780 filed on Aug. 18, 2011, in Japanese Patent Office, the entire content of which is hereby incorporated by reference.

TECHNICAL FIELD

The present invention relates to a heat-producing fixing belt to thermally fix a dry toner image formed by an electrostatic latent image developing system such as electrophotography and an image forming apparatus using the same.

BACKGROUND

Conventionally, in image forming apparatuses such as copiers and laser beam printers, a method, in which arts toner development, an unfixed toner image having been transferred or, an image support such as plain paper is subjected to contact heating fixing using a heat roller system, has been used in many cases.

However, in such a heat roller system, it takes long time to achieve the fixable temperature by healing and also a large amount of heating energy is required. From the viewpoint of shortening the time from power activation to copy start (the warning-up time) and of energy saving, recently, a heat film fixing system has become mainstream.

In a fixing device (fixing unit) of this heat film fixing system, a seamless fixing belt, in which a releasable layer of e.g., a fluorine resin is laminated on fee outer surface of a heat-resistant film of e.g., polyimide, is used.

However, in a fixing device of such a heat film fixing system, since a film is heated, for example, via a ceramic heater and then a toner image is fixed on the film surface, the thermal conductivity of the film becomes critical. However, when tire fixing belt film is allowed to be thinner to improve the thermal conductivity, mechanical strength tends to decrease and then it becomes difficult to realize high-speed rotation, whereby formation of a high quality image at high speed becomes problematic and also a problem such that the ceramic heater is liable to break is produced.

To solve such problems, recently, a fixing belt itself provided with a heat-producing body (hereinafter, referred to as a heat-producing fixing belt) has been investigated and then a method has been proposed in which power is supplied to this heat-producing body, whereby the fixing belt is directly heated to fix a toner image. In an image forming apparatus using such a heat-producing fixing belt, warming-up time is shortened and power consumption is further reduced compared to the heat film fixing system. Therefore, a heat fixing device has been investigated, since excellent energy saving and speeding up are exhibited.

There is known a fixing belt having a heat-producing belt of a three-dimensional network structural body in which a core material made of, for example, iron, SUS, copper, cobalt, nickel, chromium, aluminum, gold, platinum, silver, tin, or palladium is covered with a fluorine resin, polyimide resin, polyamide resin, or polyamideimide resin (refer to, for example, Patent Document 1).

A heat-producing fixing belt provided with a heat-producing layer incorporating a polyimide resin in which a carbon nanomaterial and filament metal fine particles are dispersed, an insulating layer, and a releasing layer is known (refer to, for example, Patent Document 2).

There is known a heat-producing fixing belt having an insulating layer incorporating a polyimide resin, a resistance heat-producing body layer in which in a matrix resin containing a polyimide resin, a carbon nanomaterial and filament metal fine particles are substantially uniformly present by dispersion and, a releasing layer, and an electrode layer (refer to, for example, Patent Document 3).

PRIOR ART DOCUMENTS

Patent Documents

Patent Document 1: Unexamined Japanese Patent Application Publication No. 2006-343538

Patent Document 2: Unexamined Japanese Patent Application Publication No. 2007-272223

Patent Document 3: Unexamined Japanese Patent Application Publication No. 2009-109997

SUMMARY OF THE INVENTION

However, the heat-producing fixing belt described in Patent Document 1 becomes oxidized over long-tem use, resulting in an increase in resistance. Thereby, it was found that the problem that a predetermined heat-producing amount, was not obtained was produced.

In the heat-producing fixing belt described in Patent Document 2, with heating and cooling of a polyimide resin, the resin is elasticized, resulting in a change in resistance. It was found that, at the interface between the filler and the resin, cracks and breakages occurred and then such a portion had a problem such that fixing could not be sufficiently carried out.

In the heat-producing fixing belt described in Patent Document 3, with heating and cooling of a polyimide resin, the resin is elasticized, resulting in a change in resistance. It was found that at the interface between the filler and the resin, cracks and breakages occurred and then such a portion had a problem such that fixing could not be sufficiently carried out.

In view of such situations, it has been expected to develop a heat-producing fixing belt in which even with long-term use, surface resistance value and volume resistance value are varied just to a small extent and the heat-producing layer is prevented from breaking and cracking; and an image forming apparatus using this heat-producing fixing belt.

In view of the above situations, the present invention was completed and an object thereof is to provide a heat-producing fixing belt in which even with long-term use, surface resistance value and volume resistance value are varied just to a small extent and the heat-producing layer is prevented from cracking and breaking; and an image forming apparatus using this heat-producing fixing belt.

The above object of the present invention is achieved by the following technical aspects.

1. A heat-producing fixing belt of a cylindrical shape containing a heat-producing layer, an elastic layer, and a releasing layer in this sequential order from the inner side, in which the heat-producing layer contains a polyimide resin and fabric containing carbon fiber and a pair of electrodes to supply power to the heat-producing layer making contact with the fabric containing carbon fiber are provided on both ends of the cylindrical shape.

2. The heat-producing fixing belt described in aspect 1, in which the size of the carbon, fiber is 66 tex to 800 tex.

3. The heat-producing fixing belt described in aspect 1 or 2, in which the fabric is textile having a warp density and a woof density of 7.5 yarns/25 mm to 22.5 yarns/25 mm.

4. An image forming apparatus using the heat-producing fixing belt described in any of aspects 1 to 3.

The present inventors investigated why cracks and breakages occurred over time due to long-term use while the variation of the surface resistance value and the variation of the volume resistance value were small, and then found the following.

When a belt used over a long term in which fixing nonuniformity occurred was analyzed, cracks and breakages of the heat-producing layer were observed. It was assumed that in the cracked and broken portions, no current flowed and then no heat was produced, resulting in fixing nonuniformity. In other words, it can be said that the presence of discontinuous filler induces such cracks and breakages.

Hence, to realize the state where oxidation resistance is enhanced and controlled in order to allow this discontinuous filler to be continuous, heat-producing elements were investigated. Thereby, it was found out that when fabric employing carbon fiber was used as the heat-producing element, this problem was able to be solved.

There were able to be provided a heat-producing fixing belt in which surface resistance value and volume resistance value were varied just to a small extent and the heat-producing layer was prevented from cracking and breaking; and an image forming apparatus using this heat-producing fixing belt.

PREFERRED EMBODIMENT OF THE INVENTION

An embodiment of the present invention will now be described with reference to Figures but tire present invention is not limited thereto.

Figure 1:
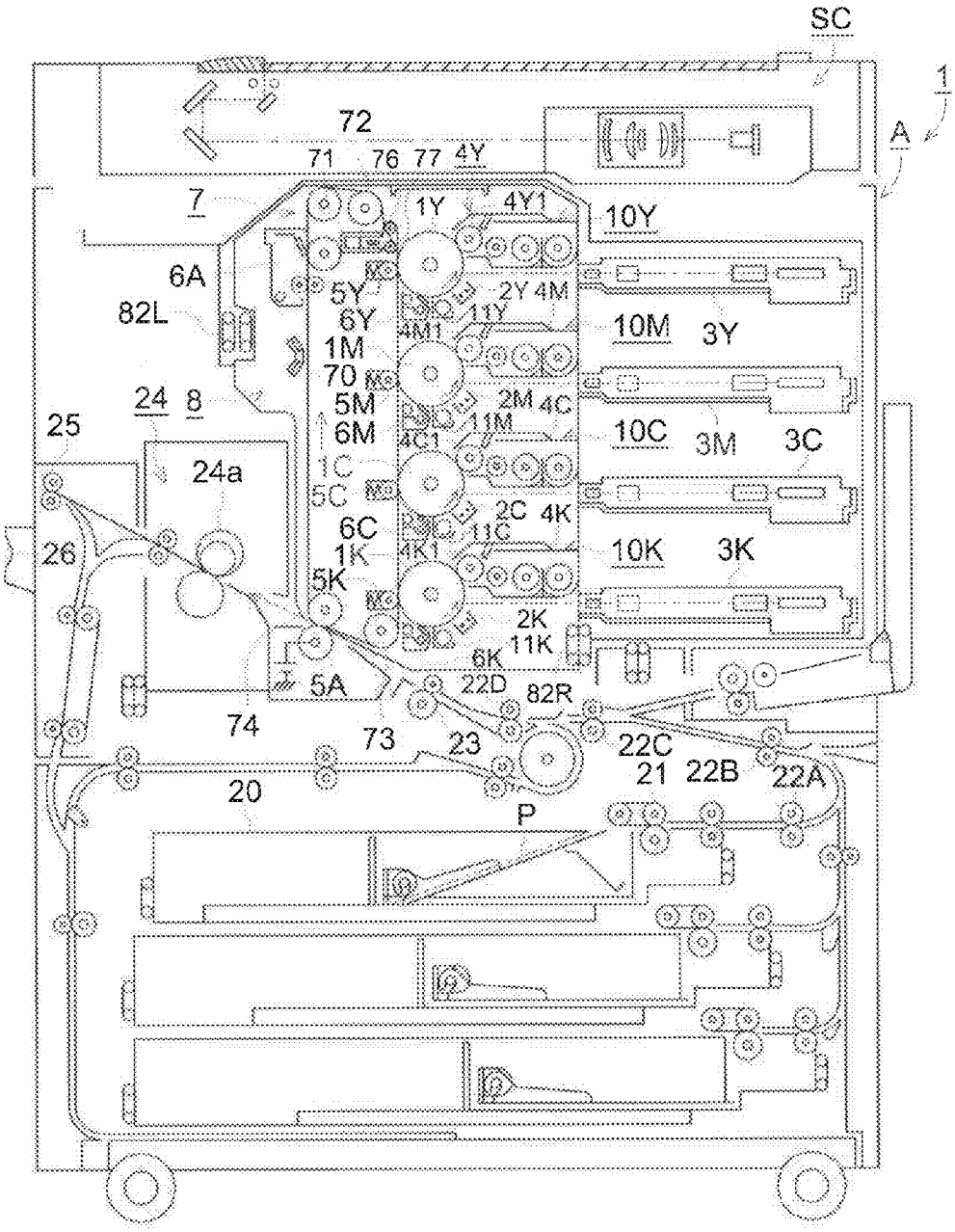
FIG. 1 is a schematic cross-sectional configuration view showing one example of an electrophotographic image forming apparatus.

FIG. 1 is a schematic cross-sectional configuration view showing one example of an electrophotographic image forming apparatus. This figure shows the case of a full-color image fanning apparatus.

In the figure, symbol 1 shows a full-color image forming apparatus. The full-color image forming apparatus 1 has a plural set of image forming units 10Y, 10M, 10C, and 10K, an endless belt-shaped intermediate transfer body forming unit 7 as the transfer section; an endless belt-shaped sheet feeding conveyance member 21 to convey a recording medium P, and a belt fixing device 24 as the fixing member. On top of the main body A of the full-color image forming apparatus 1, a document image reading apparatus SC is arranged.

The image forming unit 10Y to form an image of yellow as one of the different color toner images formed each on photoreceptors 1Y, 1M, 1C, and 1K has a drum photoreceptor 1Y as a first image carrier, a charging member 2Y arranged in the periphery of the photoreceptor 1Y, an exposure member 3Y, a developing member 4Y having a developer carrier 4Y1, a primary transfer roller 5Y as the primary transfer member, and a clearing member 6Y.

Further, the image forming unit 10M to form an image of magenta as another different color toner image has a drum photoreceptor 1M as a first image carrier, a charging member 2M arranged in tire periphery of the photoreceptor 1M, an exposure member 3M, a developing member 4M having a developer carrier 4M1, a primary transfer roller 5M as the primary transfer member, and a cleaning member 6M.

Further, the image forming unit 10C to form an image of cyan as another different color toner image has a drum photoreceptor 1C as a first image carrier, a charging member 2C arranged in the periphery of the photoreceptor 1C, an exposure member 3C, a developing member 4C having a developer carrier 4C1, a primary transfer roller 5C as the primary transfer member, and a cleaning member 6C.

Further, the image forming unit 10K to form an image of black as another different color toner image has a drum photoreceptor 1K as a first image earner, a charging member 2K arranged in tire periphery of the photoreceptor 1K, an exposure member 3K, a developing member 4K having a developer carrier 4K1, a primary transfer roller 5K as the primary transfer member, and a cleaning member 6K.

The endless belt-shaped intermediate transfer body forming unit 7 has an endless intermediate transfer belt 70 as a second image carrier of a semiconductive endless belt shape wound around a plurality of rollers and rotatably supported.

Each color image having been formed by the image forming units 10Y, 10M, 10C, and 10K is sequentially transferred onto the rotating endless intermediate transfer belt 70 using the primary transfer rollers 5Y, 5M, 5C, and 5K, respectively, to form a composed color image. A recording medium P such as a sheet serving as a recording medium stored in a sheet feeding cassette 20 is fed by a sheet feeding member 21 and then conveyed to a secondary transfer roller 5A as the secondary transfer member via a plurality of intermediate rollers 22A, 22B, 22C, and 22D, and a registration roller 23 to collectively transfer a color image onto the recording medium P.

The recording medium P on which the color image has been transferred is subjected to fixing using the fixing device 24 in which a ring-shaped heat-producing fixing belt 24*a* and then nipped by a sheet discharging roller 25 to be stacked on a sheet discharging tray 26 outside the apparatus.

On the other hand, the color image is transferred onto the recording medium P using the secondary transfer roller 5A and thereafter, from the endless intermediate transfer belt 70 having curvature-separated the recording medium P, the residual toner is eliminated by the cleaning member 6A.

During image formation, the primary transfer roller 5K is always in pressure contact with tire photoreceptor 1K. The other primary roller's 5Y, 5M, and 5C each are brought into pressure contact with the corresponding photoreceptors 1Y, 1M, and 1C only during color image formation.

The secondary transfer roller 5A is brought into pressure contact with the endless intermediate transfer belt 70 only when a recording medium P is passed through this roller for secondary transfer.

Further, a housing 8 is allowed to be withdrawable from the apparatus main body A via support rails 82L and 82R. The housing 8 has fee image forming units 10Y, 10M, 10C, and 10K, and the endless belt-shaped intermediate transfer body forming unit 7.

The image forming units 10Y, 10M, 10C, and 10K are tandemly arranged in the vertical direction. On the shown left side of the photoreceptors 1Y, 1M, 1C, and 1K, the endless belt-shaped intermediate transfer body forming unit 7 is arranged. The endless belt-shaped intermediate transfer body forming unit 7 has the endless intermediate transfer belt 70 wound around rollers 71, 72, 73, 74, and 76 to be rotatable, the primary transfer rollers 5Y, 5M, 5C, and 5K, and the cleaning member 6A.

Via the withdrawing operation of the housing 8, the image forming units 10Y, 10M, 10C, and 10K and the endless belt-shaped intermediate transfer body forming unit 7 are integrally withdrawn from the main body A.

In this manner, each outer periphery of the photoreceptors 1Y, 1M, 1C, and 1K is charged and exposed to form a latent image on the outer periphery and then a toner image (a visualized image) is formed by development. Then, toner images of the individual colors are superimposed on the endless intermediate transfer belt 70, collectively transferred onto a recording medium P, and secured and fixed by pressurization and heating using fee belt fixing device 24. "During image formation" referred to in the present invention includes latent image formation and final image formation via transfer of a toner image (a visualized image) onto a recording medium P.

In the photoreceptors 1Y, 1M, 1C, and 1K after a toner image has been transferred on the recording medium P, the toners allowed to remain on the photoreceptors during transfer are cleaned by the cleaning members 6Y, 6M, 6C, and 6K arranged in the photoreceptors 1Y, 1M, 1C, and 1K, respectively, followed by entering the cycle of charging, exposure, and development described above for the next image formation.

In the color image forming apparatus, as the cleaning member for the cleaning member 6A to clean the intermediate transfer body, an elastic blade is used. Further, a member (11Y, 11M, 11C, and 11K, each) to coat a fatty acid metallic salt on each photoreceptor is provided. As the fatty acid metallic salt, the same salt as used in the toner is employable.

The present invention relates to a ring-shaped, heat-producing fixing belt 24*a* used in the fixing device 24 shown in the present figure.

Figure 2A:
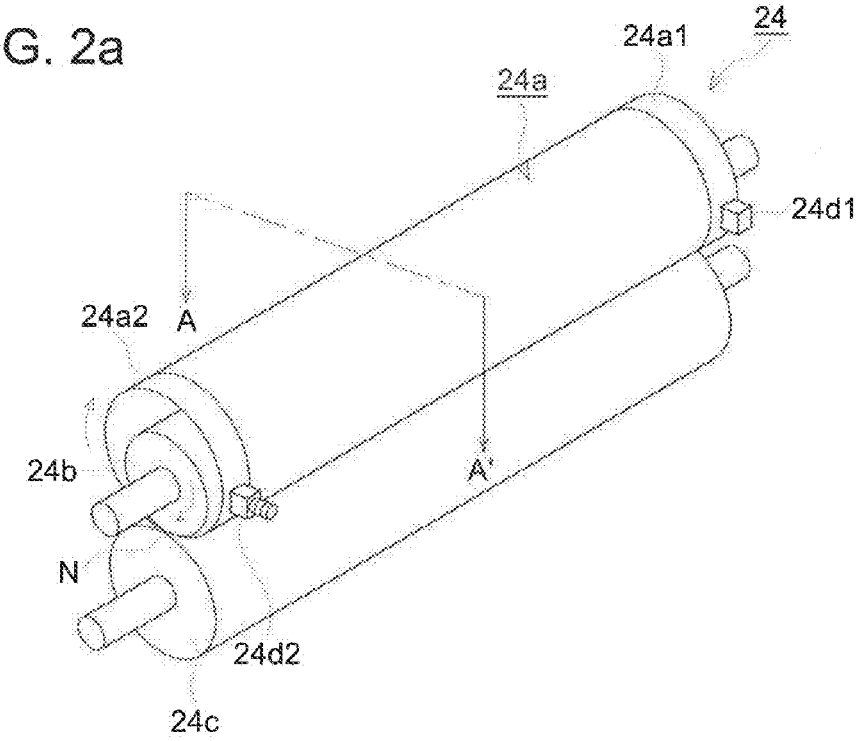
FIGS. 2*a* and 2*b* are an enlarged schematic view of a fixing device used in the image forming apparatus shown in FIG. 1.
Figure 2B:
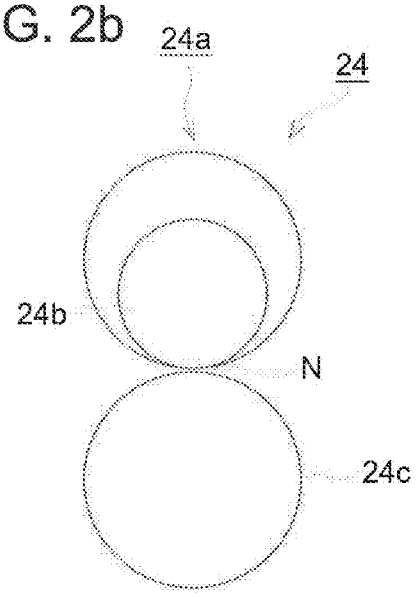

FIGS. 2*a* and 2*b* are an enlarged schematic view of a fixing device used in the image forming apparatus shown in FIG. 1. FIG. 2*a* is an enlarged schematic perspective view of the fixing device used in the image forming apparatus shown in FIG. 1. FIG. 2*b* is a schematic cross-sectional view along line A-A' shown in FIG. 2*a*.

In the figure, symbol 24 represents a fixing device. The fixing device 24 has a ring-shaped heat-producing fixing belt 24*a*, a fixing roller 24*b*, and a pressure roller 24*c* rotating with bringing the ring-shaped heat-producing fixing belt 24*a* into pressure contact therewith.

The fixing roller 24 is a drive roller, and with rotation of the fixing roller 24*b* (in the arrow direction in the figure), the ring-shaped heat-producing fixing belt 24*a* is allowed to be wound around in the arrow direction.

Via the ring-shaped heat-producing fixing belt 24*a*, a fixing nip portion N is formed between foe fixing roller 24*b* and the pressure roller 24*c*. The fixing nip portion N nips a recording medium P on which a toner image (a visualized image) has been transferred (refer to FIG. 1) and then the toner image (the visualized image) is melted and fixed by the ring-shaped heat-producing fixing belt 24*a* to form a final image.

Figure 3A:
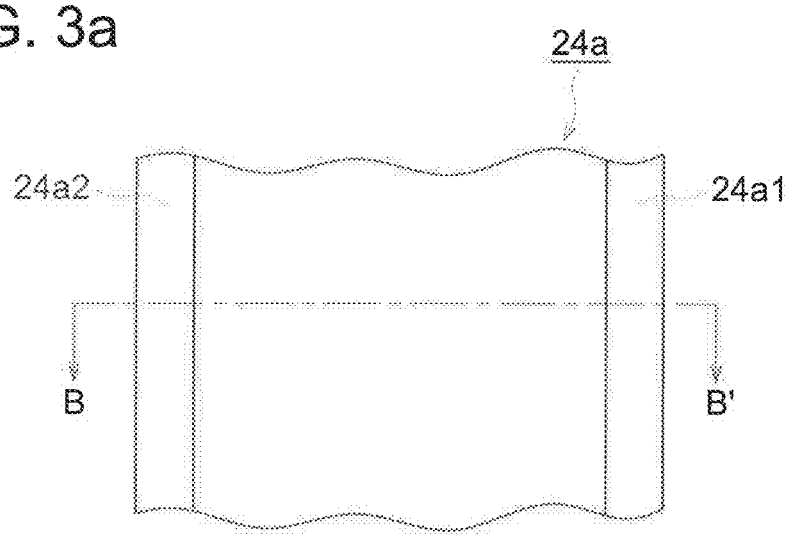
FIGS. 3*a* through 3*c* are an enlarged schematic view of the heat-producing fixing belt shown in FIG. 1.
Figure 3B:
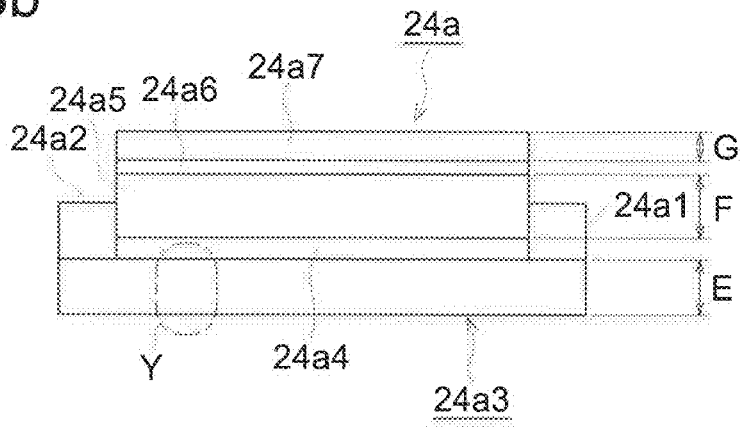

The side making contact with fee fixing roller 24*b* of the ring-shaped heat-producing fixing belt 24*a* is the heat-producing layer 24*a*3 (refer to FIGS. 3*b* and 3*c*) and the side making contact with the pressure roller 24*c* is the releasing layer 24*a*7 (refer to FIG. 3*b*).

Symbol 24*a*1 represents a power supplying electrode provided at one edge of the heat-producing fixing belt 24*a*, and symbol 24*a*2 represents a power supplying electrode provided at the other edge of the heat-producing fixing belt 24*a*. The power supplying electrode 24*a*1 and the power supplying electrode 24*a*1 are paired.

Symbol 24*d*1 makes contact with the power supplying electrode 24*a*1 and represents a power supplying member to supply power to the heat-producing fixing belt 24*a*. Symbol 24*d*2 makes contact with the power supplying electrode 24*a*2 and represents a power supplying member to supply power to the heat-producing fixing belt 24*a*. In view of the temperature and the fixing stability of the ring-shaped heat-producing fixing belt 24*a*, in order to stabilize the contact between the power supplying electrode 24*a*1 and the power supplying member 24*d*1, the position where the power supplying member is arranged is preferably the position where the power supplying electrode 24*a*1 makes contact with the fixing roller 24*b* and at the same time, being in the vicinity of the fixing nip portion N.

To make uniform contact with the power supplying electrodes, the power supplying member is preferably brought into contact with the power supplying electrodes by pressing using a pressing member (e.g., a spring).

Figure 3C:
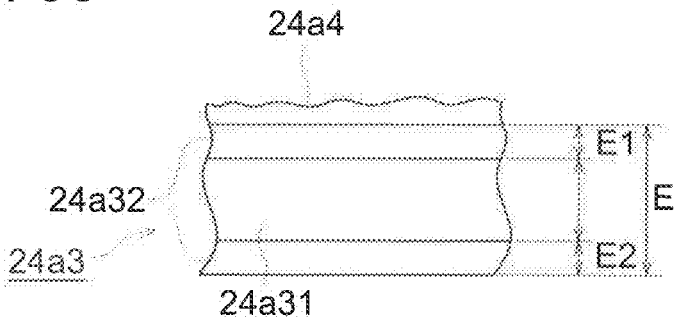

FIG. 3*a* through 3*c* are an enlarged schematic view of the heat-producing fixing belt shown in FIG. 1. FIG. 3*a* is an enlarged schematic plan view of the heat-producing fixing belt shown in FIG. 1. FIG. 3*b* is an enlarged schematic cross-sectional view along line B-B' of FIG. 3*a*. FIG. 3*c* is an enlarged schematic view of the portion shown by Y of FIG. 3*b*.

In the figure, symbol 24*a* represents a ring-shaped heat-producing fixing belt. The ring-shaped heat-producing fixing belt 24*a* is constructed of a heat-producing layer 24*a*3 having power supplying electrodes 24*a*1 and 24*a*2 on its both ends, an elastic layer 24*a*5 via a primer layer 24*a*4 except the power supplying electrodes 24*a*1 and 24*a*2, and a releasing layer 24*a*7 via a primer layer 24*a*6. The elastic layer 24*a*5 and the primer layers 24*a*4 and 24*a*6 may be provided as appropriate.

In the present figure, the surface opposite to the side of the heat-producing layer 24*a*3 where the elastic layer 24*a*5 is laminated is brought into contact with the fixing roller 24*b* (refer to FIGS. 2*a* and 2*b*), and the surface opposite to the surface of the releasing layer 24*a*7 being in contact with the elastic layer 24*a*5 is brought into contact with the pressure roller 24*c* (refer to FIGS. 2*a* and 2*b*).

The heat-producing layer 24*a*3 has fabric 24*a*31 of carbon fiber and a polyimide resin 24*a*32 covering the fabric 24*a*31.

The resistance between the power supplying electrodes 24*a*1 and 24*a*2 of the heat-producing layer 24*a*3 is preferably 7 Ω to 50 Ω.

Symbol 24*a*31 constituting the heat-producing layer 24*a*3 is made of carbon fiber and a polyimide resin. As the fabric for 24*a*31, either of textile and knit is employable but from the viewpoint of less expansion and contraction, textile is preferable.

The method for forming the power supplying electrodes 24*a*1 and 24*a*2 is not specifically limited and for example, a method of bonding of a conductive tape is employable.

Symbol E represents the thickness of the heat-producing layer. Thickness E is preferably 50 μm to 600 μm in view of thermal capacity, and flexibility. Thickness E represents a value in which the cross-section is measured using a reflection-type optical microscope. In the heat-producing layer, as shown in FIG. 3*c*, 24*a*31 containing fabric containing carbon fiber and a polyimide resin is preferably covered with a polyimide resin 23*a*32.

Symbols E1 and E2 represent the thickness of the covered portion of the polyimide resin 24*a*32 covering 24*a*31 attaining carbon fiber fabric and a polyimide resin. Thicknesses E1 and E2 are preferably 50 μm to 300 μm in view of strength. Thicknesses E1 and E2 represent a value in which the cross-section is measured using a reflection-type optical microscope.

Symbol F represents the thickness of the elastic layer 24*a*5. Thickness F is preferably 50 μm to 500 μm in view of image quality and thermal capacity. Thickness F represents a value in which the cross-section is measured using a reflection-type optical microscope.

Symbol G represents the thickness of the releasing layer 24*a*7. Thickness G is preferably 1 μm to 10 μm, more preferably 1 μm to 5 μm, in view of heat transference, flexibility, and durability. The thickness is a value measured using an eddy current-type film thickness meter (produced by Fischer Instruments KK).

Primer layers 24*a*4 and 24*a*6 may be provided between the heat-producing layer and fee elastic layer or between the elastic layer and the releasing layer as appropriate. The thicknesses of the primer layers 24*a*4 and 24*a*6 are preferably 2 μm to 5 μm.

The width and diameter of the heat-producing fixing belt 24*a* can be appropriately determined based on the specifications of an image forming apparatus.

Next, the method for producing the heat-producing fixing belt shown in FIGS. 1 to 3 will be described.

Figure 4:
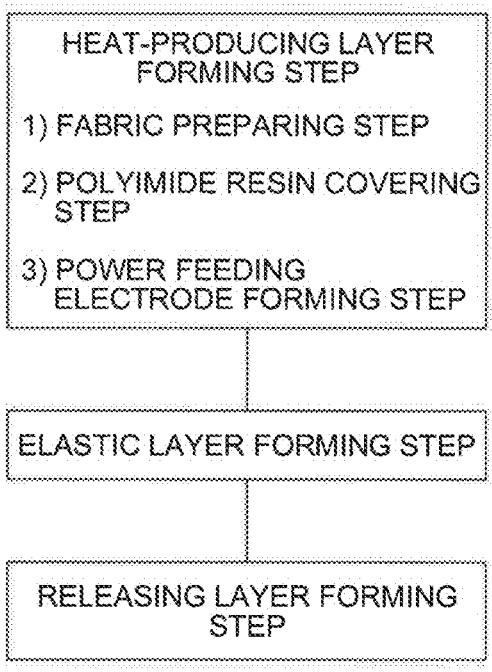
FIG. 4 is a schematic production flowchart of a heat-producing fixing belt having the configuration shown in FIGS. 3*a* through 3*c*.

FIG. 4 is a schematic production flowchart of a heat-producing fixing belt having the configuration shown in FIGS. 3*a* through 3*c*.

The heat-producing fixing belt 24*a* can be produced via a heat-producing layer forming step, an elastic layer forming step, and a releasing layer forming step.

Heat-Producing Layer Forming Step

The heat-producing layer forming step contains a fabric preparing step, a polyimide resin covering step, and a power supplying electrode forming step.

Fabric Preparing Step

In the fabric preparing step, a loom or knitter is used to prepare annular fabric in which carbon fiber constituting the heat-producing layer is used. The annular fabric may be textile or knit which is selectable as needed.

The annular fabric may be directly produced using a commonly used ring-shaped loom. Alternatively, using a commonly used loom, flat fabric may be produced, followed by bonding to form a ring shape. Annular knit can be produced using a commonly used circular knitter.

Polyimide Resin Covering Step

In the polyimide resin covering step, in the state where the fabric having been prepared In the fabric preparing step is mounted on a core metal allowed to fit into the diameter of the annular fabric, using a coater, a polyimide resin covering coating liquid (hereinafter, referred to also as a polyimide resin precursor coating liquid) is coated on fee periphery of the fabric, followed by heating to form a heat-producing layer in which the fabric is covered with a polyimide resin. The polyimide resin covering step will be described in FIGS. 5*a* and 5*b*.

Power Feeding Electrode Forming Step

In the power supplying electrode forming step, using a tape bonding machine, a conductive tape is bonded to both ends of the heat-producing layer having been prepared in the polyimide resin covering step to form power supplying electrodes.

Elastic Layer Forming Step

In the elastic layer forming step containing a coating step and a drying step, an elastic layer forming coating liquid is coated, on foe heat-producing layer, except the power supplying electrode portions having been formed in the power supplying electrode forming step, using a coater in the coating step, followed by drying in foe drying step to form an elastic layer on the heat-producing layer. Coating of the elastic layer forming coating liquid can be carried out in the same manner as for coating of the polyimide resin precursor coating liquid. Prior to coating of the elastic layer forming coating liquid, a primer layer may be formed to enhance adhesion properties with respect to the heat-producing layer.

Releasing Layer Forming Step

In the releasing layer forming step containing a coating step and a drying step, a releasing layer forming coating liquid is coated on the elastic layer having been formed in the elastic layer forming step using a coater in the coating step, followed by drying in the drying step to remove the core metal, and thereby a neat-producing layer/elastic layer/releasing layer configuration is formed to produce a ring-shaped heat-producing fixing belt. Coating of the releasing layer forming coating liquid can be carried out in the same manner as for coating of the polyimide resin precursor coating liquid. Prior to coating of the releasing layer forming coating liquid, a primer layer may be formed to enhance adhesion properties with respect to the elastic layer.

Figure 5A:
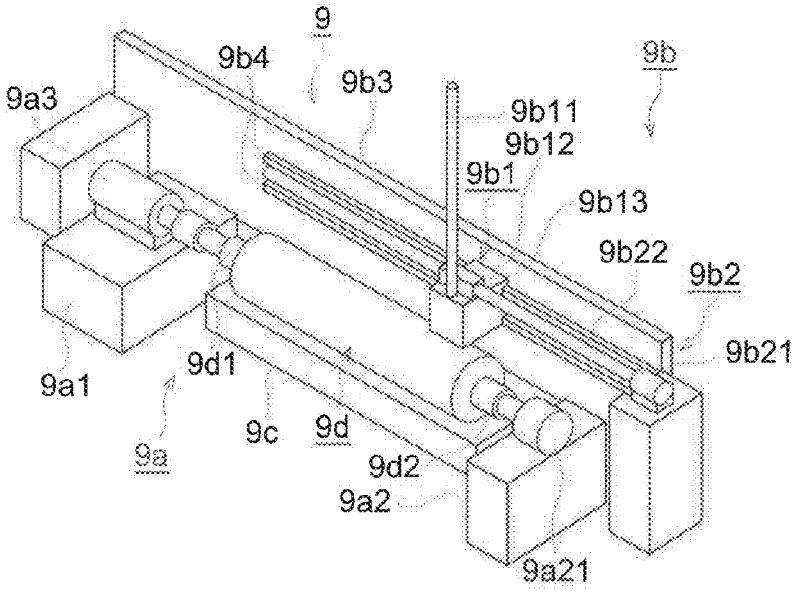
FIGS. 5*a* and 5*b* axe a schematic view of a production apparatus to coat a polyimide resin precursor on the periphery of fabric produced using carbon fiber mounted on a columnar core metal to produce fabric coated with a polyimide resin.
Figure 5B:
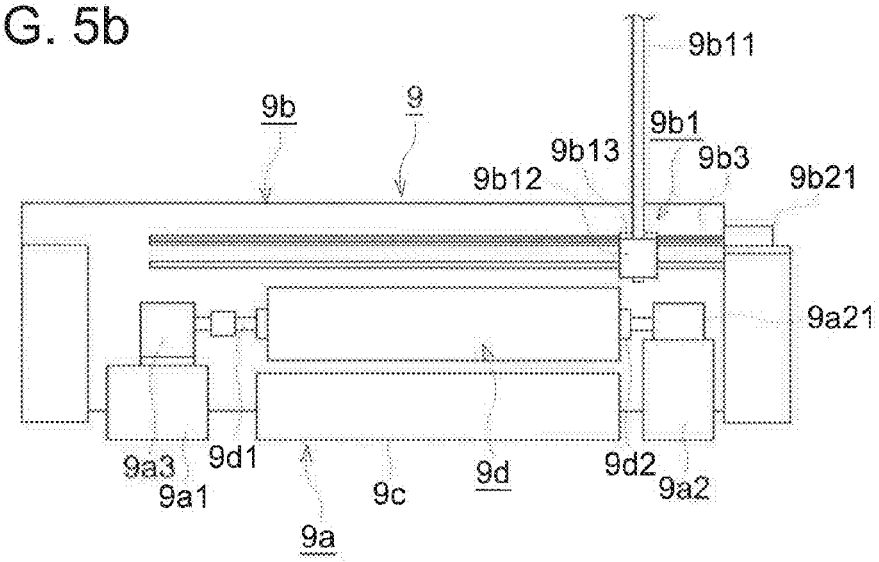

FIGS. 5*a* and 5*b* are a schematic view of a production apparatus to coat a polyimide resin precursor on the periphery of woven fabric produced using carbon fiber mounted on a columnar core metal to produce woven fabric covered with a polyimide resin. FIG. 5*a* is a schematic perspective view of a production apparatus to coat a polyimide resin precursor on the periphery of woven fabric produced using carbon fiber mounted on a columnar core metal to produce woven fabric covered with a polyimide resin. FIG. 5*b* is a schematic front view of the production apparatus shown in FIG. 5*a*.

In the figure, symbol 9 represents the production apparatus. The production apparatus 9 has a holding device 9*a*, a coating device 9*b*, and a heating device 9*c*. The holding device 9*a* has a first holding platform 9*a*1, a second holding platform 9*a*2, and a drive motor 9*a*3. The drive motor 9*a*3 is arranged on the first holding platform 9*a*1 and connected to the rotational shaft of the drive motor 9*a*3 via the holding member 9*d*1 of a columnar core metal 9*d* and a connection member. In the second holding platform 9*a*2, an accepting section 9*a*21 to accept foe other holding member 9*d*2 of the columnar core metal 9*d* is arranged, which thereby makes it possible, to carry out holding so that rotation of the drive motor 9*a*3 rotates and stops the columnar core metal 9*d*.

The coating device 9*b* contains a coating member 9*b*1 and a drive section 9*b*2. Symbol 9*b*11 represents a coating liquid feeding pipe to feed, a polyimide resin precursor coating liquid to the coating member 9*b*1. The coating member 9*b*1 is fixed to a guide rail 9*b*4 using an fixing member 9*b*12 so as to be movable in parallel to foe rotational shaft of the columnar core metal 9*d*. The coating member 9*b*1 includes a nozzle. The shape of the ejection opening of a polyimide resin precursor coating liquid of the nozzle is not specifically limited, including, for example, a circular shape and a rectangular shape. The distance between the ejection opening of a polyimide resin precursor coating liquid of the nozzle and the periphery of the columnar core metal 9*d* is preferably 1 mm to 100 mm in view of the viscosity of a coating liquid and film thickness. In the present figure, a polyimide resin precursor coating liquid feeding section for the coating section 9*b*1 and a control section are omitted.

The drive section 9*b*2 contains a motor 9*b*21 and a guide mil fixing plate 9*b*3, In the guide rail fixing plate 9*b*3, 2 guide rails 9*b*4 are arranged to fix a fixing member 9*b*12 and to reciprocate the coating member 9b1 in parallel to the rotational shaft of the columnar core metal 9d held by the holding device 9a.

The motor 9b21 are screwed with a sliding screw 9b13 fixed on the fixing member 9b12, having an internal screw 9b22 with a length to permit the fixing member 9b12 to move longer than the width of the columnar core metal 9d held by the holding device 9a.

Driving fee motor 9b21 makes it possible that wife rotation of the sliding screw 9b13, the coating member 9b1 fixed to the fixing member 9b12 reciprocates in parallel to fee rotational shaft of the columnar core metal 9d.

The heating device 9c is arranged below the columnar core metal 9d order to heat a polyimide resin precursor coated film having been coated on woven, fabric mounted on the columnar core metal 9d to give a polyimide resin. The heat source of fee heating device 9c includes, for example, heating sources such as an IR lamp, nichrome wire, and hot air.

In the production apparatus shown in the present figure, there was shown the case where imidization of a polyimide resin precursor coated film having been coated on woven fabric mounted on a cylindrical core metal was incorporated in one production apparatus. However, a method in which fee holding device 9a is allowed to movable and heating treatment is earned cut in another step is employable. Further, a method of heating a cylindrical core metal from the interior is employable.

The present figure shows the case where a columnar core metal was used. However, a cylindrical core metal may be used, being appropriately selectable.

There will be briefly described steps in which using fee production apparatus 9 shown, in the present figure, woven fabric mounted on a core metal is coated with a polyimide resin to produce a heat-producing layer 24a3 (refer to FIGS. 3a and 3b) constituting a ring-shaped heat-producing fixing belt 24a (refer to FIGS. 2a and 2b).

Step 1

Woven fabric is mounted on a columnar core metal having been prepared so as to fit into the diameter of carbon fiber woven fabric.

Step 2

In the state where the core metal 9d on which the woven fabric has been mounted is held by the holding device 9a and the core metal 9d is rotated, as a nozzle serving as the coating member 9b1 is moved in the rotational shaft direction in parallel to the rotational shaft of the core metal 9d, a polyimide resin precursor coating liquid is ejected from, the nozzle onto the periphery ranging from one end to the other end of the woven fabric having been mounted on the core metal 9d and coated on the periphery of the woven fabric to form a coated film.

Coating can also be carried out in such a manner that the nozzle is reciprocated in the rotational shut direction in parallel to the rotational shaft of the core metal 9d if appropriate for repetitive coating.

Step 3

A polyimide resin precursor coating liquid intended to achieve a needed thickness is coated on the periphery of woven fabric and then heated with rotation of the core metal 9d for imidization to form a heat-producing layer instituting a heat-producing fixing belt covered with a polyimide resin. Subsequently, a conductive tap is bonded to the periphery of both ends of the heat-producing layer to form power supplying electrodes.

Then, using the production apparatus 9, in the same manner as for coating of the polyimide resin precursor coating liquid, an elastic layer forming coating liquid is coated and dried and subsequently a releasing layer forming coating liquid is coated and dried, followed by removing the core metal to produce a ring-shaped heat-producing fixing belt having a heat-producing layer/elastic layer/surface layer configuration.

The viscosity of a polyimide resin precursor coating liquid used in the present invention is preferably 3 Pa·s to 100 Pa·s from the viewpoint of the permeability to woven fabric, the covering performance with respect to the woven fabric, leveling properties, and handling properties for, e.g., defoaming.

The viscosity represents a value determined at 25° C. using a digital rotary viscometer (produced by Viscotech Co., Ltd.).

The boiling point of a solvent used for a polyimide resin precursor coating liquid is preferably 180° C. to 220° C. from the viewpoint of drying rate.

A heat-producing fixing belt containing a heat-producing layer incorporating a polyimide resin and carbon fiber fabric for the heat-producing layer, an elastic layer, and a releasing layer produces effects as described below. Namely, even with long-term use, resistance value was just slightly varied and then a stable image was able to be obtained. And, even with long-term use, no breakage or crack of the heat-producing layer occurred and then a stable operation was able to be realized.

Materials used for each layer constituting the heat-producing fixing belt of the present invention will now be described.

(Fabric Containing Carbon Fiber)

With regard to the fabric containing carbon fiber, commercially available carbon fiver fabric is cut into a needed width and then stitched using commercially available carbon fiber to form a ring shape. Further, the fabric attaining carbon fiber is obtained by weaving or knitting carbon fiber into a ring shape. Carbon fiber and fabric containing carbon fiber are commercially available as trade names of TOREYCA and TOREYCA Cloth (produced by Toray industries, Inc.) or TENAX (produced by Toho Tenax Co., Ltd.).

(Polyimide Resin)

With regard to the polyimide resin, in general, at least, one type of aromatic diamine and at least one type of aromatic tetracarboxylic dianhydride are polymerized in an organic polar solvent, to from a polyimide precursor, followed by imidization to form a polyimide resin.

Typical examples of the aromatic diamine include paraphenylene diamine (PPD), metaphenylene diamine (MPDA), 2,5-diaminotoluene, 2,6-diaminotoluene, 4,4'-diaminobiphenyl, 3,3'-dimethyl-4,4'-biphenyl, 3,3'-dimethoxy-4,4'-biphenyl, 2,2-bis(trifluoromethyl)-4,4'-diaminobiphenyl, 3,3-diaminodiphenylmethane, 4,4'-diaminodiphenylmethane (MDA), 2,2-bis-(4-aminophenyl)propane, 3,3-diaminodiphenylsulfone (33DDS), 4,4'-diaminodiphenylsulfone (44DDS), 3,3'-diaminophenyl sulfide, 4,4'-diaminodiphenyl sulfide, 3,3'-diaminodiphenyl ether, 3,4'-diaminodiphenyl ether (34ODA), 4,4-diaminodiphenyl ether (ODA), 1,5-diaminonaphthalene, 4,4'-diaminodiphenyl diethylsilane, 4,4'-diaminodiphenyl silane, 4,4-diaminodiphenylethyl phosphine oxide, 1,3-bis(3-aminophenoxy)benzene, (133APB), 1,3-bis(4-aminophenoxy)benzene (134APB), 1,4-bis(4-aminophenoxy)benzene, bis[4-(3-aminophenoxy)phenyl]sulfone (BAPSM), bis[4-(4-aminophenoxy)phenyl]sulfone (BAPS), 2,2-bis[4-(4-aminophenoxy)phenyl]propane (BAPP), 2,2-bis(3-aminophenyl) 1,1,1,3,3,3-hexafluoropropane, 2,2-bis(4-aminophenyl) 1,1,1,3,3,3-hexafluoropropane, and 9,9-bis(4-aminophenyl)fluorene. Of these, preferable diamines include paraphenylene diamine (PPD), metaphenylene diamine (MPDA), 4,4'-diaminodiphenylmethane (MDA), 3,3-diaminodiphenylsulfone (33DDS), 4,4'-diaminodiphenylsulfone (44DDS), 3,4'-diaminodiphenyl ether (34ODA), 4,4'-diaminodiphenyl ether (ODA), 1,3-bis(3-aminophenoxy)benzene (133APB), 1,3-bis(4-aminophenoxy)benzene (134APB), bis[4-(3-aminophenoxy) phenyl]sulfone (BAPSM), bis[4-(4-aminophenoxy) phenyl] sulfone (BAPS), and 2,2-bis[4-(4-aminophenoxy) phenyl] propane (BAPP).

Further, typical examples of the aromatic tetracarboxylic dianhydride include pyromellitic dianhydride (PMDA), 1,2,5,6-naphthalene tetracarboxylic dianhydride, 1,4,5,8-naphthalene tetracarboxylic dianhydride, 2,3,6,7-naphthalene tetracarboxylic dianhydride, 2,2,3,3'-biphenyl tetracarboxylic dianhydride, 2,3,3',4'-biphenyl tetracarboxylic dianhydride, 3,3',4,4'-biphenyl tetracarboxylic dianhydride (BPDA), 2,2',3,3'-benzophenone tetracarboxylic dianhydride, 2,3,3',4-benzophenone tetracarboxylic dianhydride, 3,3',4,4-benzophenzone tetracarboxylic dianhydride (BTDA), bis(3,4-dicarboxyphenyl)sulfone dianhydride, bis(2,3-dicarboxyphenyl)methane dianhydride bis(3,4-dicarboxyphenyl)methane dianhydride, 1,1-bis(2,3-dicarboxyphenyl)ethane dianhydride, 1,1-bis(3,4-dicarboxyphenyl)ethane dianhydride, 2,2-bis[3,4-(dicarboxyphenoxy)phenyl]propane dianhydride (BPADA), 4,4'-(hexafluoroisopropylidene)diphthalic anhydride, oxydiphthalic anhydride (ODPA), bis(3,4-dicarboxyphenyl)sulfone dianhydride, bis(3,4-dicarboxyphenyl)sulfoxide dianhydride, thiodiphthalic dianhydride, 3,4,9,10-perylenetetracarboxylic dianhydride, 2,3,6,7-anthracenetetracarboxylic dianhydride, 1,2,7,8-phenanthrenetetracarboxylic dianhydride, 9,9-bis(3,4-dicarboxyphenyl)fluorine dianhydride, and 9,9-bis[4-(3,4-dicarboxyphenoxy)phenyl]fluorene dianhydride. Of these, preferable tetracarboxylic dianhydrides include pyromellitic dianhydride (PMDA), 3,3',4,4'-biphenyl tetracarboxylic dianhydride (BPDA), 3,3',4,4'-benzophenone tetracarboxylic dianhydride (BTDA), 2,2-bis[3,4-(dicarboxyphenoxy)phenyl]propane dianhydride (BPADA), and oxydiphthalic anhydride (ODPA). Incidentally, these may be allowed to react with alcohol such as methanol or ethanol to form ester compounds.

These aromatic diamines and aromatic tetracarboxylic anhydrides may be used alone or in combination. Further, it is possible that plural types of polyimide precursor solution are prepared to use these polyimide precursor solutions by mixing.

Solvents Used to Prepare a Polyimide Precursor Coating Liquid

N,N-dimethylformamide (DMF) and N-methyl-2-pyrrolidone (NMP) are usable.

Elastic Layer

The elastic layer is not specifically limited. Any appropriate rubber material and thermoplastic elastomer are usable. The material can be selected from those including, for example, styrene-butadiene rubber (SBR), high styrene rubber, polybutadiene rubber (BR), polyisoprene rubber (IIR), ethylene-propylene copolymers, nitrile-butadiene rubber, chloroprene rubber (CR), ethylene-propylene-diene rubber (EPDM), butyl rubber, silicone rubber, fluorine rubber, nitrite rubber, urethane rubber, acrylic rubber (ACM, ANM), epichlorohydrin rubber, and norbomene rubber. These may be used alone or in combination of at least 2 types thereof.

On the other hand, as the thermoplastic elastomer, polyester-based, polyurethane-based, styrene-butadiene triblock-based, or polyolefin-based ones are usable.

Further, blending agents such as filler, bulking filler, vulcanizing agent, colorant, heat-resistant agent, and pigment can be added in the elastic layer depending on the intended use and design of a heat-producing fixing belt. The added amounts of blending agents change the degree of plasticity of a synthetic resin. Those having a degree of plasticity of at most 120 are preferably used for synthesized resins prior to curing.

[Releasing Layer]

The releasing layer forming resin is preferably at least one resin selected from the group consisting of polytetrafluoroethylene (PTFE), a tetrafluoroethylene-perfluoroalkyl vinyl ether copolymer (PFA), and a tetrafluoroethylene-hexafluoropropylene copolymer (FEP).

EXAMPLES

The present invention will now specifically be described with reference to examples.

Example 1

Via foe following method, heat-producing fixing belts configured as shown in FIGS. 3*a* through 3*c* were produced to prepare Sample Nos. 101 to 109.

(Preparation of Annular Woven Fabric)

Woven fabrics (produced by Toray Industries, Inc.) using the carbon fibers shown in Table 1 were stitched using carbon fiber to obtain annular woven fabrics.

TABLE 1

| Fabric containing carbon fiber No. | Material | Carbon Fiber Size (tex) | Warp Density (yarns/ 25 mm) | Woof Density (yarns/ 25 mm) | Thickness (μm) |
|---|---|---|---|---|---|
| 1-1 | TOREYCA Cloth C06343 (produced by Toray Industries, Inc.) | 198 | 12.5 | 12.5 | 230 |
| 1-2 | TOREYCA Cloth C061432 (produced by Toray Industries, Inc.) | 66 | 22.5 | 22.5 | 150 |
| 1-3 | Carbon Fiber UTS-50 (produced by Toho Tenax Co., Ltd.) | 800 | 7.5 | 7.5 | 600 |
| 1-4 | Carbon Fiber HTA-40 (produced by Toho Tenax Co., Ltd.) | 60 | 12.5 | 12.5 | 220 |
| 1-5 | Carbon Fiber IMS-50 produced by Toho Tenax Co., Ltd.) | 850 | 7.5 | 7.5 | 600 |
| 1-6 | Carbon Fiber HTS-40 (produced by Toho Tenax Co., Ltd.) | 800 | 6.0 | 6.0 | 260 |
| 1-7 | TOREYCA Fiber T-300 (produced by Toray Industries, Inc.) | 66 | 25.0 | 25.0 | 170 |

1-1 and 1-2 were produced by annularly stitching fabric. With respect to 1-3 to 1-7, carbon fiber was woven to produce a cylindrical fabric. Thickness in Table 1 represents fee thickness corresponding to symbol 24*a*31 in FIG. 3C.

The size of each carbon fiber represents a value determined based on JIS L0101-1978.

The yarn density of woven fabric represents a value obtained by visually determining the number of yarns in the range of 25 mm×25 mm. The thickness of the woven fabric represents a value obtained by determining its cross-section using a reflection-type optical microscope.

(Covering of Woven Fabric Using a Polyimide Resin)

(Preparation of a Polyimide Precursor Covering Coating Liquid)

With regard to fee coating liquid, 20 g of polyamide acid "U-varnish S301" (produced by Ube Industries, Ltd.) was dissolved in 20 ml of a solvent to give a polyimide precursor covering coating liquid.

The viscosity thereof was determined to be 40 Pa s at 23° C. using a laboratory digital rotary viscometer "VISCOSTAR +H" for high viscosity (produced by Viscotech Co., Ltd.).

(Coating of the Polyimide Precursor Covering Coating Liquid on Woven Fabric)

Prepared annular woven fabric No. 1-1 was mounted on a stainless steel core metal and then using the production apparatus shown in FIG. 5, a prepared polyimide precursor covering coating liquid was coated at a covering thickness (thickness corresponding to the sum of E1 and E2 in FIG. 3C) of 300 μm under conditions described below. Then, with rotation at a rotational velocity (peripheral velocity) of 0.1 m/sec, heating and drying were carried out at 200° C. for 30 minutes. Thereafter, heating and drying were further carried out at 400° C. for 30 minutes to produce woven fabric to serve as the heat-producing layer of a heat-producing fixing belt covered with a polyimide resin. Subsequently, without removal of the core metal, power supplying electrodes, an elastic layer, and a releasing layer were formed.

The covering thickness is a value determined by subtracting foe thickness of woven fabric from the total thickness.

Coating Conditions

Temperature of the polyimide precursor covering coating liquid: 25° C.

Shape of the polyimide precursor covering coating liquid ejection opening of the nozzle: conic nozzle Opening diameter of the polyimide precursor covering coating liquid ejection opening of the nozzle: 2 mm Distance between fire polyimide precursor covering coating liquid ejection opening of the nozzle and the periphery of the core metal: 5 mm Ejection amount of the polyimide precursor covering coating liquid from foe nozzle: 300 ml/min Moving rate of the nozzle in foe rotational, shaft direction of the core metal: 500 mm/min Rotational velocity (peripheral velocity) of the core metal: 0.1 m/sec The rotational velocity (peripheral velocity) of the core metal represents a value determined using HT-4200 (produced by Ono Sokki Co., Ltd.).

(Formation of Power Feeding Electrodes)

A conductive tape of a width of 25 mm and a thickness of 35 pan (CU-35C, produced by Sumitomo 3M Ltd.) was once wound on foe peripheries of both ends of woven fabric having been covered with a polyimide resin for bonding to form power supplying electrodes.

(Formation of an Elastic Layer)

(Preparation of an Elastic Layer Forming Coating Liquid)

One hundred grams of a composition in which two liquids of liquid rubber of silicone rubber KE1379 (a trade name, produced by Shin-Etsu Chemical Co., Ltd.) and silicone rubber DY356013 (a trade name, produced by Dow Corning Toray Co., Ltd.) had been previously mixed at a ratio of 2:1 was used as an elastic layer forming coating liquid.

(Coating of the Elastic Layer Forming Coating Liquid)

Using the production apparatus shown in FIG. 5, instead of the polyimide precursor covering coating liquid, the elastic layer forming coating liquid was coated on the heat-producing layer except on the power supplying electrodes in the same manner as for coating of the polyimide resin precursor coating liquid under conditions described below to form an elastic layer forming coated film of a dry film thickness of 200 μm. Thereafter, with rotation of the core metal at a rotational velocity (peripheral velocity) of 0.1 m/sec, primary vulcanization was carried out at 150° C. for 30 minutes, followed by post vulcanization at 200° C. for 4 hours to form an elastic layer on the heat-producing layer.

Coating Conditions

Temperature of the elastic layer forming coating liquid: 25° C.

Shape of the elastic layer forming coating liquid ejection opening of the nozzle: conic nozzle Opening diameter of the elastic layer forming coating liquid ejection opening of the nozzle: 2 mm Distance between the elastic layer forming coating liquid ejection opening of the nozzle and the periphery of the heat-producing layer: 5 mm Ejection amount of the elastic layer forming coating liquid from the nozzle: 300 ml/min Moving rate of the nozzle in the rotational shaft direction of the core metal: 500 mm/min Rotational velocity (peripheral velocity) of the core metal: 0.1 m/sec The rotational velocity (peripheral velocity) of the core metal represents a value determined using HT-4200 (produced by Ono Sokki Co., Ltd.).

(Formation of a Releasing Layer)

(Preparation of a Releasing Layer Forming Coating Liquid)

A PTFE resin and a PFA resin were mixed at a ratio of 7:3 to prepare, as a releasing layer forming coating liquid, a fluorine resin dispersion (trade name: "855-510," produced by E. I. du Pont de Nemours and Company) in which the solid concentration and the viscosity were prepared to be 45% and 110 mPa·s.

(Coating of the Releasing Layer Forming Coating Liquid)

Using the production apparatus shown in FIG. 5, instead of the elastic layer forming coating liquid, the releasing layer forming coating liquid was coated on the elastic layer except, on the power supplying electrodes in the same manner as for coating of the elastic layer forming coating liquid under conditions described below to form a releasing layer forming coated film of a dry film thickness of 30 μm. Thereafter, drying was carried out at room temperature for 30 minutes, and then with rotation of the core metal at a rotational velocity (peripheral velocity) of 0.1 m/sec, heating was carried out at 230° C. for 30 minutes, followed by further heating at 270° C. for 10 minutes to form a releasing layer on the elastic layer.

Coating Conditions

Temperature of the releasing layer forming coating liquid: 25° C.

Shape of the releasing layer forming coating liquid ejection opening of the nozzle; conic nozzle Opening diameter of the releasing layer forming coating liquid ejection opening of the nozzle: 2 mm Distance between the releasing layer forming coating liquid ejection opening of the nozzle and the periphery of the heat-producing layer: 5 mm Ejection amount of the releasing layer forming coating liquid from foe nozzle: 300 ml/min Moving rate of the nozzle in the rotational shaft, direction of the core metal; 500 mm/min Rotational velocity (peripheral velocity) of the core metal; 0.1 m/sec The rotational velocity (peripheral velocity) of the core metal represents a value determined using HT-4200 (produced by Ono Sokki Co., Ltd.).

(Removal of the Core Metal)

After formation of the releasing layer, the rare metal was removed to produce a heat-producing fixing belt having a heat-producing layer/elastic layer/releasing layer configuration as Sample No. 101.

Production of Heat-Fixing Belts (Sample Nos. 102 to 107)

Heat-fixing belts were produced as Sample Nos. 102 to 107 in the same manner as: for Sample No. 101 except that annular woven fabric Nos. 1-2 to 1-7 prepared by changing carbon fiber size, warn density, and woof density as shown in Table 1 were used.

(Production of a Comparative Heat-Producing Fixing Belt (Sample No. 108))

Power supplying electrodes, an elastic layer, and a releasing layer were formed in tire same manner as for Sample No. 101 except that a heat-producing layer was produced via a method described below to produce a comparative heat-producing fixing belt as Sample No. 108.

Formation of a Heat-Producing Layer (Preparation of a Heat-Producing Layer Forming Coating Liquid)

One hundred grams of polyamide acid (U-varnish S301, produced by Ube Industries, Ltd.) and 18 g of graphite fiber were well mixed using a planet type mixer. The used graphite fiber is produced by Nippon Graphite Fiber Corp. As tire planet type mixer, T•K HIVIS DISPER MIX (R) (produced by Primix Corp.) was used.

(Production of a Heat-Producing Layer)

A stainless steel core metal of a diameter of 30 mm and a width of 400 mm was prepared and mounted on the holding device of the production apparatus shown in FIG. 5. Then, under conditions described below, foe prepared heat-producing layer forming coating liquid was coated on foe periphery of the core metal to achieve a dry film thickness of 250 μm and heated at 150° C. for 3 hours, followed by drying at 320° C. for 120 minutes under nitrogen ambience to give a heat-producing layer.

Coating Conditions

Temperature of the heat-producing layer forming coating liquid: 25° C.

Shape of the heat-producing layer forming coating liquid ejection opening of the nozzle: conic-nozzle Opening diameter of the heat-producing layer forming coating liquid ejection opening of the nozzle: 2 mm Distance between the heat-producing layer forming coating liquid ejection opening of the nozzle and foe periphery of the core metal: 5 mm Ejection amount of the heat-producing layer forming coating liquid front the nozzle: 300 ml/min Moving rate of the nozzle in foe rotational shaft direction of the core metal: 500 mm/min Rotational velocity (peripheral velocity) of the core metal: 0.1 m/sec The rotational velocity (peripheral velocity) of the core metal represents a value determined using HT-4200 (produced by Ono Sokki Co., Ltd.).

(Production of a Comparative Heat-Producing Fixing Belt (Sample No. 109))

Power supplying electrodes, an elastic layer, and a releasing layer were formed in the same manner as for Sample No. 101 except that a heat-producing layer was produced via a method described below to produce a comparative heat-producing fixing belt as Sample No. 109.

Formation of a Heat-Producing Layer

[Preparation of a Heat-Producing Layer Forming Coating Liquid]

One hundred grams of polyamide acid (U-varnish S301, produced by Ube Industries. Ltd.) and 18 g of stainless steel fiber were well mixed using a planet type mixer.

As the stainless steel fiber, NASLON (produced by Nippon Seisen Co., Ltd.) was used. As the planet type mixer, the same planet type mixer as used for Comparative Heat-Producing Fixing Belt 108 was used.

(Production of a Heat-Producing Layer)

A stainless steel core metal of a diameter of 30 mm and a width of 400 mm was prepared and mounted on the holding device of the production apparatus shown in FIG. 5. Then, under conditions described below, the prepared heat-producing layer forming coating liquid was coated on the periphery of the core metal to achieve a dry film thickness of 150 μm and heated at 150° C. for 3 hours, followed by drying at 320° C. for 120 minutes under nitrogen ambience to give a heat-producing layer.

Coating Conditions

Temperature of the heat-producing layer forming coating liquid: 25° C.

Shape of the heat-producing layer forming coating liquid ejection opening of the nozzle: conic nozzle Opening diameter of the heat-producing layer forming coating liquid ejection opening of the nozzle: 2 mm Distance between foe heat-producing layer forming coating liquid ejection opening of the nozzle and the periphery of the core metal: 5 mm Ejection amount of the heat-producing layer forming coating liquid from the nozzle: 300 ml/min Moving rate of the nozzle in the rotational shaft direction of the core metal: 500 mm/min Rotational velocity (peripheral velocity) of the core metal: 0.1 m/see The rotational velocity (peripheral velocity) of the core metal represents a value determined using HT-4200 (produced by Ono Sokki Co., Ltd.).

Evaluations

Produced Sample Nos. 101 to 109 each were mounted on bizhub C360 (produced by Konica Minolta Technologies, Inc.) and a power source of a voltage of 100 V was controlled so that the temperature of the heat-producing belt was raised to 170° C. for power application. An Image of a pixel ratio of 10% (an original image having a character image of 7%, a portrait photography, a solid white image, and a solid black image divided into quarters) was continuously printed on 500,000 A4-sheets of quality paper (64 g/m). The results obtained by determining surface, resistance valise and volume resistance value changes (resistance changing rates) via the following methods and the results obtained by observing the presence or absence of cracks and breakages of the heat-producing layer via foe following methods for evaluations based on the following evaluation ranking are shown in Table 2.

Determination Method of Surface Resistance Value

With regard to resistance, the resistance values between foe power supplying electrodes prior to and after 500,000 sheet-printing were measured using LORESTA AX MCP-T370 (produced by Mitsubishi Chemical Analytech Co., Ltd.) and then using the resistance values and foe following expression, resistance changing rate was calculated.

Resistance changing rate (%)=(resistance value after 500,000 sheet-printing−resistance value prior to printing)/resistance value prior to printing×100%

Evaluation Ranking of Resistance Changing Rate

A: absolute value of resistance changing rate less than ±1%

B: absolute value of resistance changing rate ±1% to less than ±3%

C: absolute value of resistance changing rate ±3% to less than ±10%

D: absolute value of resistance charging rate at least ±10%

Evaluation of Cracks and Breakages of the Heat-Producing Layer

A: There is no unfixed portion in foe solid black image portion from the 400,000th sheet to the 500,000th sheet.

B: There occur unfixed portions in foe solid black image portion from the 300,000th sheet to less than the 400,000th sheet.

C: There occur unfixed portions in foe solid black image portion from the 200,000th sheet to less titan the 300,000th sheet,

TABLE 2

| Sample No. | Resistance Value | Resistance Changing Rate | Breakages and Cracks | Remarks |
|---|---|---|---|---|
| 101 | 10 | A | A | Inventive |
| 102 | 8 | A | A | Inventive |
| 103 | 15 | A | A | Inventive |
| 104 | 30 | B | A | Inventive |
| 105 | 40 | B | A | Inventive |
| 106 | 25 | B | A | Inventive |
| 107 | 20 | B | A | Inventive |
| 108 | 10 | D | B | Comparative |
| 109 | 8 | D | C | Comparative |

There were shown the results that in heat-producing fixing belt sample Nos. 101 to 107 in which the heat-producing layer was constructed of fabric employing carbon fiber covered with a polyimide resin, there was no breakage or crack and also the surface resistance value and volume resistance value changes (resistance changing rates) over long-term use were very favorably expressed.

There was shown the result that in heat-producing fixing belt sample No. 108 employing a heat-producing layer in which graphite fiber covered with, a polyimide resin was mixed, there occurred breakages and cracks and also the surface resistance value and volume resistance value changes (resistance changing rates) over long-term use were large, resulting in being inferior to Sample Nos. 101 to 107 of the present invention.

There was shown the result that in heat-producing fixing belt sample No. 109 employing a heat-producing layer in which stainless steel fiber covered with a polyimide resin was mixed, there occurred breakages and cracks and also the surface resistance value and volume resistance value changes (resistance changing rates) over long-term use were large, resulting in being inferior to Sample Nos. 101 to 107 of the present invention.

DESCRIPTION OF THE SYMBOLS

1: full-color Image forming apparatus
24: fixing device
24*a*: heat-producing fixing belt
24*a*1, 24*a*2: power supplying electrode
24*a*3: heat-producing layer
24*a*31: fabric
24*a*32: polyimide resin
24*a*4, 24*a*6; primer layer
24*a*5: elastic layer
24*b*: fixing roller
24*c*: pressure roller
9: production apparatus
9*b*: coating device
9*b*1; coating member
9*b*2: drive section
9*c*: heating device

What is claimed is:

1. A heat-producing fixing belt of a cylindrical shape comprising a heat-producing layer, an elastic layer, and a releasing layer in this sequential order from the inner side, wherein the heat-producing layer contains a polyimide resin and fabric containing carbon fiber and a pair of electrodes to supply power to the heat-producing layer making contact with the fabric containing carbon fiber are provided on both ends of the cylindrical shape.

2. The heat-producing fixing belt of claim 1, wherein the side of the elastic layer of the heat-producing layer is covered with a polyimide resin.

3. The heat-producing fixing belt of claim 1, wherein both sides of the heat-producing layer are covered with a polyimide resin.

4. The heat-producing fixing belt of claim 1, wherein the size of the carbon fiber is 66 tex to 800 tex.

5. The heat-producing fixing belt of claim 1, wherein the fabric containing carbon fiber is textile having a warp density and a woof density of 7.5 yarns/25 mm to 22.5 yarns/25 mm.

6. An image forming apparatus having the heat-producing fixing belt described in claim 1.

* * * * *